US008959685B2

(12) United States Patent
Misaki et al.

(10) Patent No.: US 8,959,685 B2
(45) Date of Patent: Feb. 24, 2015

(54) CUSHION CELL AND CUSHION BODY USING THE SAME

(71) Applicant: Tokai Rubber Industries, Ltd., Aichi (JP)

(72) Inventors: Akitsugu Misaki, Aichi (JP); Takahiro Koda, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 0 days.

(21) Appl. No.: 14/156,783

(22) Filed: Jan. 16, 2014

(65) Prior Publication Data

US 2014/0130264 A1 May 15, 2014

Related U.S. Application Data

(63) Continuation of application No. PCT/JP2012/005434, filed on Aug. 29, 2012.

(30) Foreign Application Priority Data

Aug. 29, 2011 (JP) ..... 2011-186410

(51) Int. Cl.
*A47C 27/08* (2006.01)
*A47C 27/10* (2006.01)
(Continued)

(52) U.S. Cl.
CPC ..... *A61G 7/05769* (2013.01); *A47C 27/081* (2013.01); *A47C 27/10* (2013.01); *A61G 7/015* (2013.01); *A61G 7/05715* (2013.01); *A61G 2203/34* (2013.01)
USPC ..... 5/713; 5/710; 5/655.3

(58) Field of Classification Search
CPC .. A47C 27/083; A47C 27/082; A47C 27/081; A47C 27/08; A47C 27/10; A61G 7/05769; A61G 7/05776; A61G 2203/34
USPC ..... 5/713, 710, 706, 644, 654, 655.3
See application file for complete search history.

(56) References Cited

U.S. PATENT DOCUMENTS 4,104,425 A 8/1978 Hirmann
4,541,136 A * 9/1985 Graebe ..... 5/655.3
(Continued)

FOREIGN PATENT DOCUMENTS

JP 03-039105 2/1991
JP B-2615206 5/1997
(Continued)

OTHER PUBLICATIONS

International Search Report dated Oct. 2, 2012 w/English language translation.
(Continued)

*Primary Examiner* — Robert G Santos
(74) *Attorney, Agent, or Firm* — Greenblum & Bernstein, P.L.C.

(57) ABSTRACT

The objective of the present invention is to provide: a cushion cell with a new structure which is designed to disperse stresses when the cushion cell is in an inflated state such that excellent durability is achieved and in which a large support area for the human body can be obtained with excellent space efficiency relative to a square shaped space for disposal in an inflated state; and a cushion body with a new structure using the same. The cushion cell is formed with a fluid chamber inside and the height of the cushion cell can be changed by adjusting the pressure in the fluid chamber. The planar shape of the cushion cell in a deflated state is a square shape, and each side part has a curved shape protruding outwards.

8 Claims, 12 Drawing Sheets

(51) Int. Cl.
*A61G 7/057* (2006.01)
*A61G 7/015* (2006.01)

(56) References Cited

U.S. PATENT DOCUMENTS 4,698,864 A * 10/1987 Graebe ..... 5/654
5,052,068 A * 10/1991 Graebe ..... 5/654
5,163,196 A * 11/1992 Graebe et al. ..... 5/654
5,533,220 A * 7/1996 Sebag et al. ..... 5/654
5,689,845 A * 11/1997 Sobieralski ..... 5/654
7,958,789 B2 6/2011 Hayakawa et al.
8,745,797 B2 * 6/2014 Misaki et al. ..... 5/710
2013/0263379 A1 * 10/2013 Misaki ..... 5/713
2014/0013514 A1 * 1/2014 Misaki ..... 5/710
2014/0101862 A1 * 4/2014 Misaki ..... 5/710
2014/0130264 A1 * 5/2014 Misaki et al. ..... 5/713

FOREIGN PATENT DOCUMENTS

JP 2000-005243 1/2000
JP B-3560033 9/2004

OTHER PUBLICATIONS

International Preliminary Report on Patentability for PCT/JP2012/005434, mailed Mar. 4, 2014.

* cited by examiner

CUSHION CELL AND CUSHION BODY USING THE SAME

INCORPORATED BY REFERENCE

The disclosure of Japanese Patent Application No. 2011-186410 filed on Aug. 29, 2011 including the specification, drawings and abstract is incorporated herein by reference in its entirety. This is a Continuation of International Application No. PCT/JP2012/005434 filed on Aug. 29, 2012.

BACKGROUND OF THE INVENTION

1. Field of the Invention

The present invention relates to a cushion cell, the height of which can be changed by adjusting the pressure in a fluid chamber to cause the stretch of the cell, and to a cushion body such as a mattress using the cushion cell.

2. Description of the Related Art

Conventionally, as a cushion body that can prevent pressure gangrene (bedsore) and achieve excellent sleeping comfort and so forth due to the dispersion of body pressure, one with multiple cushion cells has been proposed, and application thereof to mattresses and other items is being studied. In other words, the cushion body is to be arranged on the bed surface and the like supporting the human body with a structure where a plurality of cushion cells each having a fluid chamber inside are provided and arranged in line. And, the human body support surface is configured by a collaborative action of multiple cushion bodies by having each cushion cell inflated with pressurized fluid supplied thereto. For example, the one disclosed in Japanese Patent No. JP-B-2615206 is such an item.

Meanwhile, since the cushion body is generally in an approximate shape of a cuboid, the disposition area of each cushion cell composing the cushion body is usually made into a square in plan. In a cushion body made of a plurality of cushion cells arranged in line, once a gap is created between cushion cells adjacent to each other, a problem occurs such as generation of bedsore and deterioration of touch feeling due to concentrated pressures of the human body. Therefore, if the disposition area is a square, it is desirable to make the top face of the cushion cell into a square corresponding to the disposition area.

However, in a deflated state of the cushion cell, if the top face thereof is made into a square form, the free length in the meridian direction varies along the circumferential direction around the central axis in inflating the cushion cell by pressurizing the fluid chamber so that stresses are focused on the side portion where the free length in the meridian direction is shorter to generate a constricted deformation with a depression along the outer periphery of the side. As a result, there was a risk of developing a problem of reduced durability of the cushion cell due to a concentrated action of stresses and unwanted gaps formed between the cushion cells adjacent to each other because of the constricted deformation.

SUMMARY OF THE INVENTION

The present invention has been developed in view of the background described above, and the problem to be solved thereby is to provide a cushion cell with a new structure where stress dispersion therein in an inflated state and excellent durability are achieved and a larger support area for the human body can be obtained with excellent space efficiency relative to the square-shaped space for disposition in an inflated state.

Also, the present invention aims at providing a cushion body with a new structure using the above cushion cell.

A first mode of the present invention provides a cushion cell including: a fluid chamber formed therein such that a height of the cushion cell is changeable by adjusting a pressure in the fluid chamber, wherein a shape of the cushion cell in a deflated state is a square in plan with each side portion curved in a convex manner toward an outer periphery.

Using the cushion cell with the structure according to the first mode mentioned above, in an inflated state of the cushion cell in a square shape in plan, concentration of stresses against the center portion of the sides caused by the difference in free lengths in the meridian direction can be reduced by having each side portion curved in a convex manner toward the outer periphery in an deflated state. Therefore, even if a user jumps on the cushion cell in an inflated state, any damage thereof can be avoided, thus achieving improved durability.

Also, since the center portion of the sides is prevented from getting constricted (depressed to be concave along the outer periphery) in an inflated state due to stress diffusion by means of making the sides in a curved shape, the cushion cell in an inflated state is arranged with excellent space efficiency relative to the square-shaped space for disposition. Therefore, each cushion cell can support the human body over a wider area, thus exerting the effect of preventing pressure gangrene (bedsore) due to the dispersion of body pressure.

Furthermore, since the size of each cushion cell in an inflated state is secured efficiently relative to the square-shaped space for disposition, it is possible to enlarge the maximum height of each cushion cell, thus giving a wider range of height adjustability of each cushion cell.

In addition, since the constricted deformation of the side portion in an inflated state can be reduced, if a cushion cell is arranged adjacent to another member such as a different cushion cell or one made of urethane foam, the gap caused by the constricted deformation of the cushion cell can be reduced. Therefore, unevenness of the surface abutting against the human body due to the gap can be restricted, thus preventing concentrated pressures of the human body.

A second mode of the present invention provides the cushion cell according to the first mode, wherein a maximum outward protrusion of the side portion is made 0.05 to 0.15 times a length of the side portion.

According to the second mode, as the side portion gets closer to a linear shape in a state of inflation, if the disposition area for the cushion cells (the area where the cushion cells support the human body) is made in a square shape, each cushion cell can support the human body over a wider area so that the prevention effect of bedsore and the like can be obtained more favorably due to the dispersion of body pressure. Also, a wider range of height adjustability (maximum height) of each cushion cell can be obtained, thus effectively achieving body pressure dispersion by means of adjusting the height of each cushion cell.

Additionally, when a plurality of cushion cells are arranged in line or adjacent to a block of urethane foam or the like in a rectangular shape, formation of gaps due to the protrusion or depression of the side portion toward the outer periphery can be restricted. This prevents the body pressure from concentrating on the outer edge of the cushion cells, thus achieving the prevention effect of bedsore and the like due to the dispersion of body pressure.

A third mode of the present invention provides the cushion cell according to the first or second mode, wherein the cushion cell comprises a cell body formed by means of fixing at least one set of sheets overlapped on each other along peripheries thereof in a fluid tight manner.

According to the third mode, by making each sheet in a square shape with its side portion curved in a convex manner toward the outer periphery, a cell body or even a cushion cell in a desired shape can be easily obtained. Moreover, by forming each sheet in a given shape, the curvature of the side portion (protrusion toward the outer periphery) and the like can be set in high precision.

A fourth mode of the present invention provides the cushion cell according to any one of the first to third modes, wherein each corner portion of the cushion cell is curved in a convex manner toward the outer periphery, while a curvature radius of the corner portion is made smaller than that of the side portion.

According to the fourth mode, since concentration of stresses at each corner is alleviated, improved durability due to stress dispersion can be achieved more effectively. In addition, since each corner is curved in a smaller curvature radius than that of the side portion, an approximate shape of a square is maintained in plan so that the area for supporting the human body and the volume of the fluid chamber are secured efficiently.

Meanwhile, either the corner or side portion does not necessarily have to be formed entirely in a constant curvature radius, but the curvature radius can change gradually or in steps. In such a case, the average curvature radius of all the corners can just be made smaller than that of all the side portions.

A fifth mode of the present invention provides a cushion body adapted to be arranged on a human body support surface including a plurality of cushion cells according to any one of the first through fourth modes to be arranged in line on the human body support surface.

Using the cushion body with the structure according to the fifth mode mentioned above, since the plurality of cushion cells arranged in line on the human body support surface restrict the constricted deformation of each of their side portions in an inflated state, the gap between cushion cells adjacent to each other in the lined-up direction is restricted. Therefore, on the top face of the cushion cells abutting directly or indirectly against the human body, concentration of body pressures on the outer edges of the cushion cells can be prevented, thus preventing generation of bedsore and the like.

Also, because of the large adjustable range of the cushion cell height, the surface of the cushion body configured on the top face of the cushion cells can be made to respond to the surface configuration of the human body in high precision by adjusting the pressure in the fluid chamber of each cushion cell. Therefore, the body pressure is dispersed to prevent bedsore and the like.

According to the present invention, by means of making the cushion cell into a square shape with each side portion curved in a convex toward the outer periphery in a deflated state, concentration of stresses acting against the side portion in an inflated state can be prevented, thus improving the durability of the cushion cell. Also, since the side portions are restricted from getting constricted to be depressed toward the inner periphery in an inflated state, the support area of the cushion cells relative to the square-shaped space for disposition can be obtained efficiently.

BRIEF DESCRIPTION OF THE DRAWINGS

The foregoing and/or other objects, features and advantages of the invention will become more apparent from the following description of a preferred embodiment with reference to the accompanying drawings in which like reference numerals designate like elements and wherein.

DETAILED DESCRIPTION OF PREFERRED EMBODIMENTS

Embodiments of the present invention will be described below in reference to the drawings.

Figure 13:
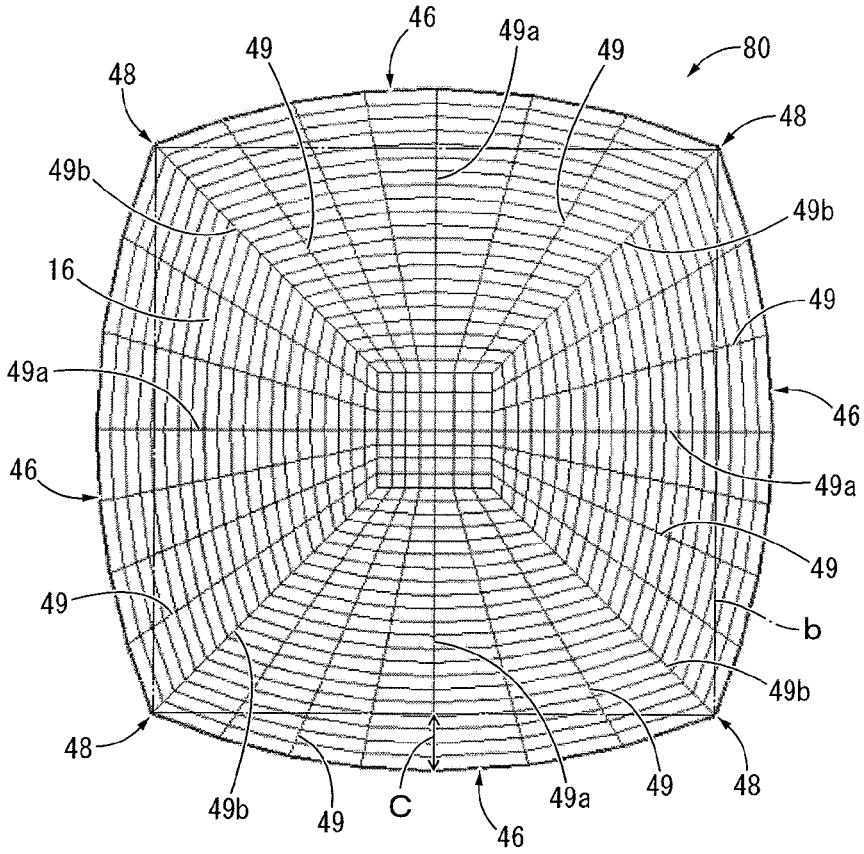
FIG. 13 is a plan view of the cushion cell shown in FIG. 12 in a deflated state.
Figure 14:
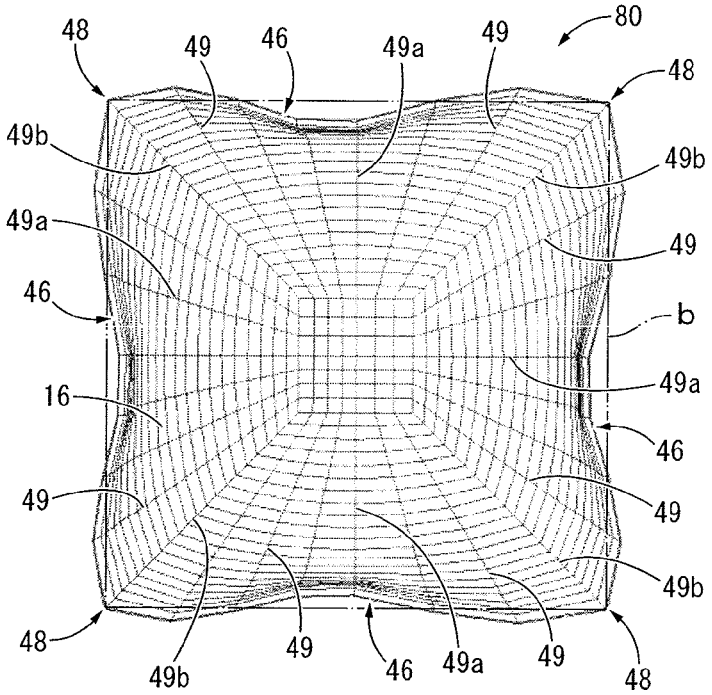
FIG. 14 is a plan view of the cushion cell shown in FIG. 12 in an inflated state.

FIGS. 1 to 5 show a cushion cell 10 as a first embodiment of the present invention. The cushion cell 10 is in the shape of a bag as a whole and its height is made changeable by adjusting the pressure in a fluid chamber 36 formed therein to be described later. Also, the cushion cell 10 comprises an upper bag portion 12 and a lower bag portion 14 as cell bodies. In the following descriptions, the vertical direction means an up-and-down direction of FIG. 2 unless otherwise noted. Also, for better understanding of the drawings, meridians 49 (to be described later) and latitudes are shown on the cushion cell surface in FIGS. 1, 4 and 5 as well as FIGS. 12 to 14, which will be described later.

More specifically, the upper bag portion 12 is formed by having a top portion 16 as a sheet and an upper intermediate portion 20 as a sheet formed with an opening 18 at the center welded to each other along an outer periphery 22 thereof. Meanwhile, the lower bag portion 14 is formed by having a bottom portion 26 as a sheet with a port 24 attached at the center and a lower intermediate portion 30 as a sheet formed with an opening 28 at the center welded to each other along an outer periphery 32. Then, the cushion cell 10 is formed by means of welding the upper intermediate portion 20 and the lower intermediate portion 30 to each other along each edge of the openings 18 and 28, and the upper bag portion 12 and the lower bag portion 14 are made to tilt against each other on both sides of a constricted portion 34 formed in the intermediate portion of the cushion cell 10 in the height direction.

Representative examples of the material for the sheet composing the above cushion cell 10 include thermoplastic elastomer, more specifically, polyurethane elastomer, or otherwise, olefin, styrene, polyamide elastomer. Also, in the present embodiment, the upper bag portion 12 and the lower bag portion 14 are made nearly the same in size and shape, but they can be differentiated from each other.

Inside the cushion cell 10 with a structure as described above, a fluid chamber 36 is formed. This fluid chamber 36 is formed by having the inner space of the upper bag portion 12 and the inner space of the lower bag portion 14 communicated with each other via a communication portion 38 using the openings 18, 28 of the bag portions 12, 14. Also, the fluid chamber 36 is almost tightly sealed against the exterior and is communicated thereto via a port 24 in a cylindrical shape provided through the bottom portion 26 of the cushion cell 10. Then, by supplying and exhausting a fluid such as air to and from the fluid chamber 36 via the port 24, the pressure inside the fluid chamber 36 is adjusted so as to switch the cushion cell 10 between the inflated state shown in FIGS. 1 and 2 and the deflated state shown in FIG. 3, or an intermediate state in between.

Figure 1:
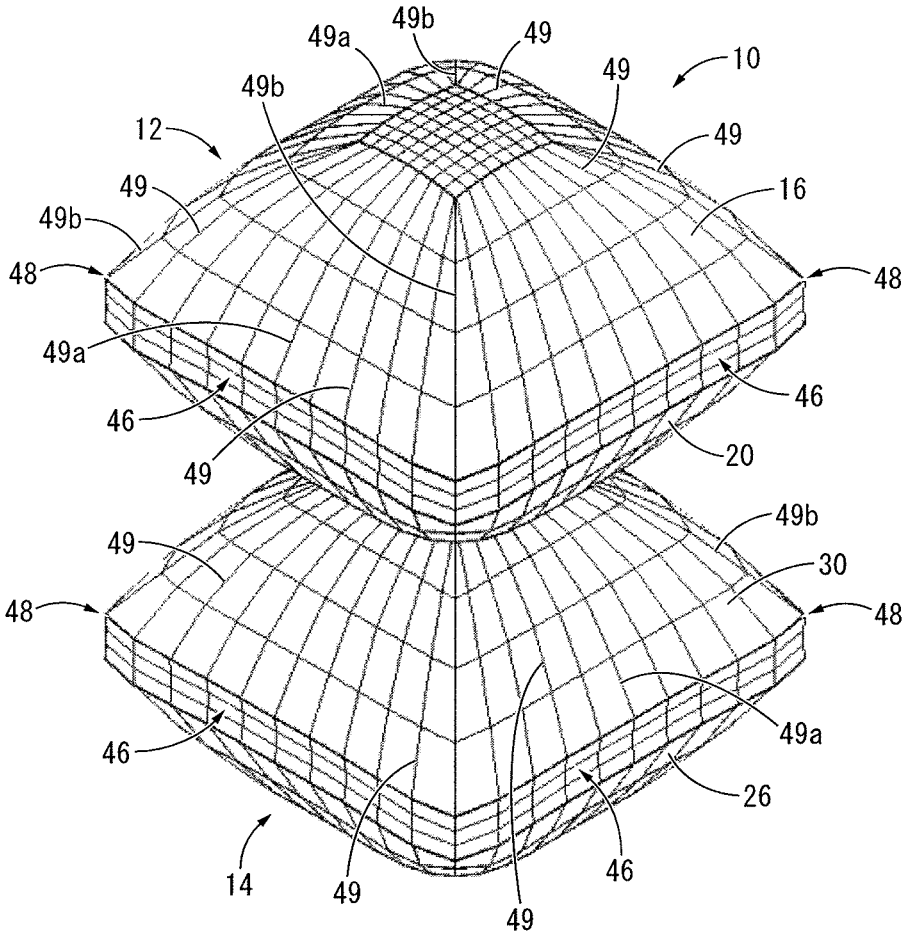
FIG. 1 is an perspective view of a cushion cell in an inflated state shown as a first embodiment of the present invention.
Figure 2:
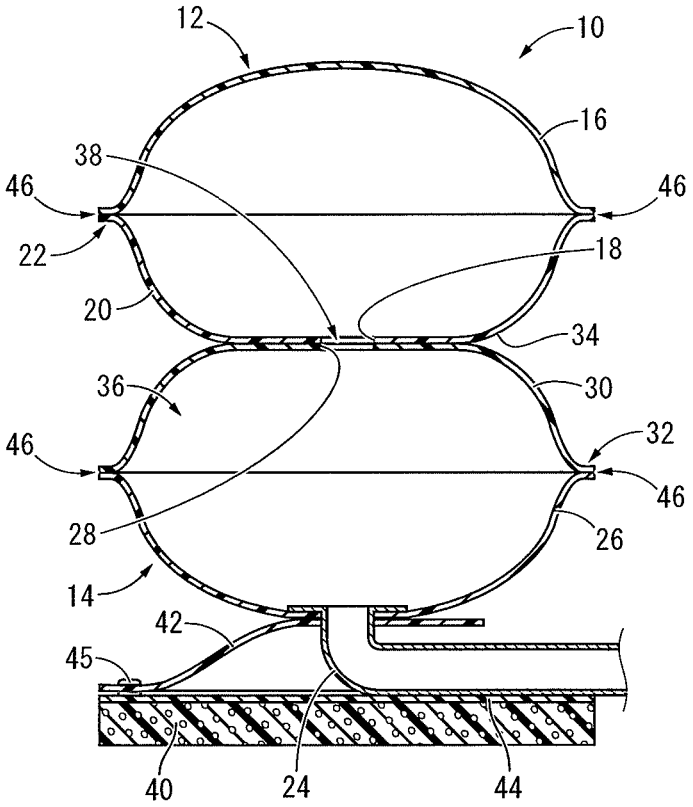
FIG. 2 is a longitudinal cross section of the cushion cell shown in FIG. 1, taken along line 2-2 in FIG. 5.
Figure 3:
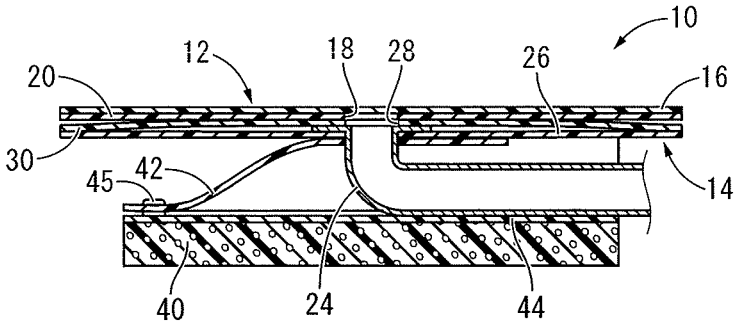
FIG. 3 is a longitudinal cross section of the cushion cell shown in FIG. 1 in a deflated state.

In FIGS. 2 and 3, the cushion cell 10 is arranged on a bottom cushion layer 40. More specifically, a mounting sheet 42 in a rectangular shape is superposed over the bottom portion 26 of the cushion cell 10 wherein the port 24 is inserted into the through hole formed through the mounting sheet 42, while the edge portion of the through hole is welded to the bottom portion 26. Then, the cushion cell 10 is installed to stand up on the bottom cushion layer 40 by having the mounting sheet 42 installed, by a fixing means 45 such as snapping, on a fixing sheet 44 arranged on the bottom cushion layer 40 made of urethane foam or the like. However, the arrangement structure of the cushion cell 10 is not particularly limited.

Figure 4:
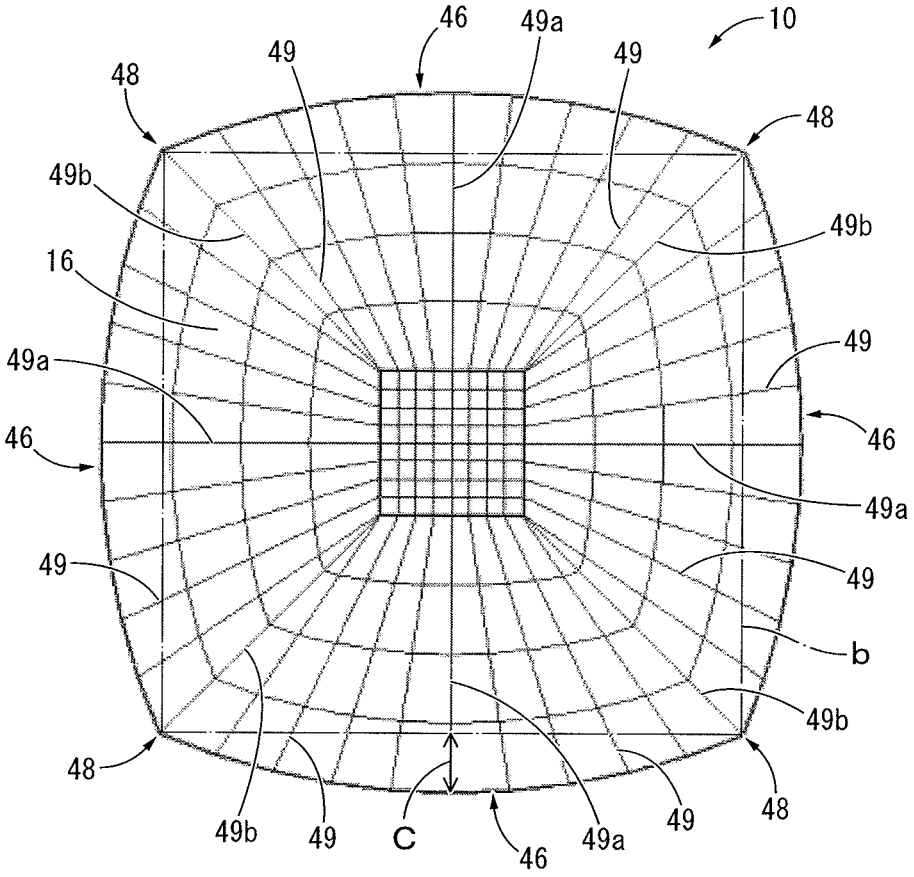
FIG. 4 is a plan view of the cushion cell shown in FIG. 1 in a deflated state.
Figure 5:
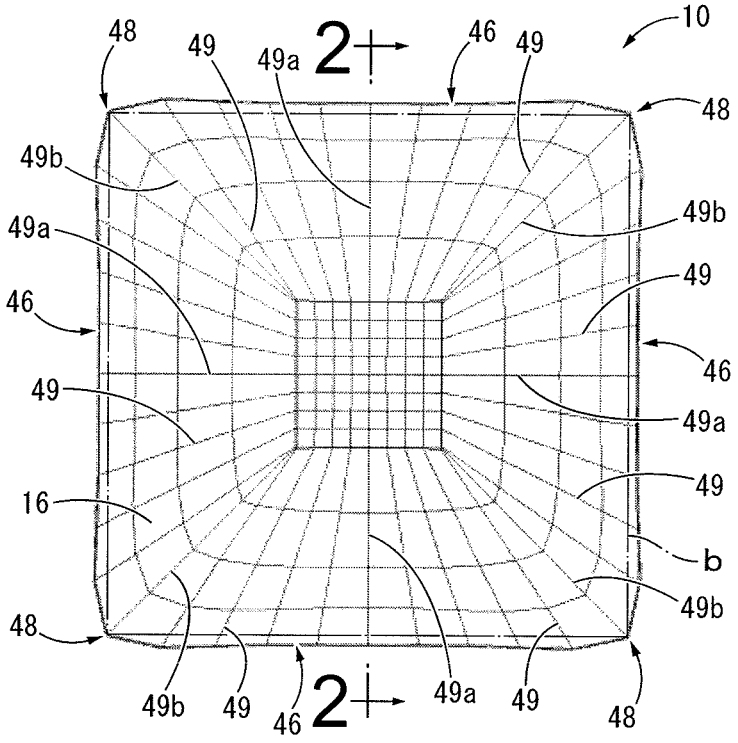
FIG. 5 is a plan view of the cushion cell shown in FIG. 1 in an inflated state.

Also, as shown in FIG. 4, the cushion cell 10 is made in an approximate shape of a square in plan in a deflated state. The deflated state of the cushion cell 10 indicates a condition as shown in FIG. 3 where pressurized fluid (air) is exhausted from the fluid chamber 36.

In addition, in the cushion cell 10, the four side portions 46 are each curved in an arc to make a convex shape toward the outer periphery against a reference line b (the dashed -dotted lines in F*ig*.4) linearly connecting corner portions 48. Also, in the present embodiment, the protrusion of the side portion 46 against the reference line b is gradually increased toward the center in the length direction of the side portion 46 to reach the maximum at the center in the length direction.

The maximum protrusion C of the side portion 46 toward the outer periphery (the amount of protrusion of the side portion 46 at the center in the length direction) is preferably to be set at 0.05 to 0.15 times the length l of the side portion 46. More preferably, the maximum protrusion C of the side portion 46 is set at 0.1 to 0.15 times the length l of the side portion 46, and in the present embodiment 0.1 times.

Also, the four corner portions 48 are each curved in an arc to make a convex toward the outer periphery and the curvature radius thereof is made smaller than that of the side portions 46. This allows the cushion cell 10 to be made in a smoothly curved shape with no corners all the way around substantially keeping an approximate square shape in plan view.

Since the cushion cell 10 of the present embodiment is formed by welding the four sheets (the top portion 16, upper intermediate portion 20, lower intermediate portion 30, and bottom portion 26) to each other, such a form in a deflated state can be achieved easily from each shape of the sheets. In summary, the top portion 16, upper intermediate portion 20, lower intermediate portion 30, and bottom portion 26 are all made in a approximate square sheet with its side portion 46 curved in a convex toward the outer periphery, while the corner portions 48 are curved in a smaller curvature radius than that of the side portions 46. In such cushion cell 10 formed with a plurality of sheets, the side portions 46 and corner portions 48 with intended curvature radii can be obtained easily and with high accuracy of form by means of forming each sheet in a prescribed shape.

In the present embodiment, the top portion 16 of the upper bag portion 12 is in an approximate shape of a square having the side portions 46 and corner portions 48 as described above, while the upper intermediate portion 20 of the upper bag portion 12 as well as the bottom portion 26 and the lower intermediate portion 30 of the lower bag portion 14 are in nearly the same outer peripheral configuration as that of the top portion 16. This makes the cushion cell 10 entirely in an approximate shape of a square in vertical view with a double-decker structure composed of the upper bag portion 12 and the lower bag portion 14 in nearly the same configuration as each other. However, the bottom portion 26 and the lower intermediate portion 30 can be formed in a different shape from that of the top portion 16, or the upper bag portion 12 and the lower bag portion 14 can be made in different shapes.

Then, as fluid is sent to the fluid chamber 36 of the cushion cell 10 in a deflated state (FIGS. 3 and 4) to heighten the pressure in the fluid chamber 36, the height of the cushion cell 10 is increased, while the projection area in the vertical direction is decreased. Especially, since the cushion cell 10 is made in an approximate shape of a square in plan, the deformation of the side portion 46 toward the inner periphery at its center where the free length is minimized gets larger than that of the corner portion 48. The free length means the length of the meridian 49 equivalent to the distance on the cell 10 surface from the upper end of the inflated cushion cell 10 (center of the top portion 16) in the longitudinal section including the central axis to the bottom end thereof (inner peripheral edge of the bottom portion 26).

Here in the cushion cell 10, the difference between the free length in a diagonal direction and the free length in an opposite side direction is restricted by having the side portion 46 curved in an arc to make a convex shape toward the outer periphery in a deflated state and by making the center of the side portion 46 protrude in advance toward the outer periphery relative to the reference line b.

Thus, in the cushion cell 10, concentration of stresses at the side portions 46 in an inflated state is alleviated by means of making the side portion 46 curved in a convex toward the outer periphery and restricting the difference between the free length in an opposite side direction (length of a meridian 49*a* passing through the center of the side portions 46) and the free length in a diagonal direction (length of a meridian 49*b* passing through the corner portions 48). Therefore, when the user's body weight is further applied to the cushion cell 10 in an inflated state with the fluid chamber 36 highly pressurized, damage to the cushion cell 10 can be avoided by dispersing the stresses, thus improving the durability thereof.

In addition, since the corner portions 48 are also curved in a convex toward the outer periphery, which are smoothly connected to the side portions 46, stress concentration at each corner portion 48 and each connection between the side portions 46 and the corner portion 48 is prevented, thus resulting in higher durability. The projection area [of the cushion cell] in the vertical direction is made in an approximate shape of a square in an inflated state by having the curvature radius of the corner portion 48 formed in an arc shape made smaller than that of the side portion 46 also formed in an arc.

Also, since the center of the side portion 46 in a deflated state protrudes toward the outer periphery beyond the reference line b, the amount of constriction at the center of the side portion 46 toward the inner periphery relative to the reference line b is reduced due to the inflation, and at the same time, the amount of protrusion of the center of the side portion 46 toward the outer periphery is reduced. Especially, by setting the maximum protrusion C from the reference line b of the side portion 46 in a deflated state at 0.05 to 0.15 times the length of the side portion 46, the side portion 46 gets closer to a straight line in an inflated state so that the cushion cell 10 forms an approximate square. This allows the cushion cell 10 to achieve better space efficiency in an inflated state relative to the area for disposition thereof in a square shape so as to secure a large area for supporting the human body and prevent generation of pressure gangrene (bedsore) due to the dispersion of body pressure.

Moreover, since the projection area of the cushion cell 10 in the vertical direction is efficiently secured relative to the area for disposition thereof if the area for disposition is in a square, the maximum height of the cushion cell 10 is increased to offer a larger area for height adjustment. In other words, the shape of each sheet composing the cushion cell 10 (the top portion 16, upper intermediate portion 20, lower intermediate portion 30, and bottom portion 26) is set in such a way that the projected shape of the cushion cell 10 in the vertical direction in an inflated state is contained within the area for disposition. Since the cushion cell 10 of the present embodiment in an inflated state is in a square shape in projection in the vertical direction roughly corresponding to the area of disposition thereof, the area of each sheet can be secured to the maximum extent so that the maximum height obtained by deformation of the sheet becomes adjustable in a wide range. Since the cushion cell 10 is made in a double-decker structure provided with the upper bag portion 12 and the lower bag portion 14, the adjustable range of the height can be set wider.

Figure 6:
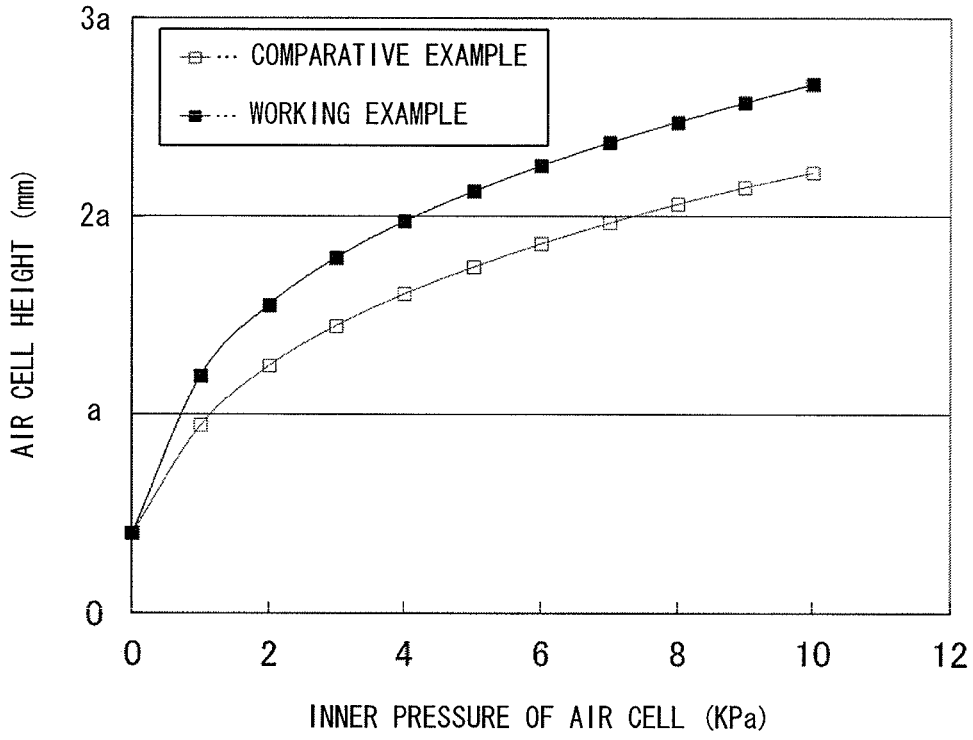
FIG. 6 is a graph showing a correlation between the inner pressure of the fluid chamber and the cushion cell height.

It is evident from the graph of measurement results shown in FIG. 6 that the height dimension of the cushion cell 10 is efficiently determined as described above. In other words, according to the graph of FIG. 6, the cushion cell 10 related to the present embodiment as a working example has a larger height than a cushion cell related to the conventional structure as a comparative example, assuming that the pressure in the fluid chamber 36 remains the same, and it is also indicated that the height dimension can efficiently be set larger. The comparative example shown in FIG. 6 is a cushion cell in a rounded square shape where the side portions are made straight lines and the corner portions are rounded in an arc.

Figure 7:
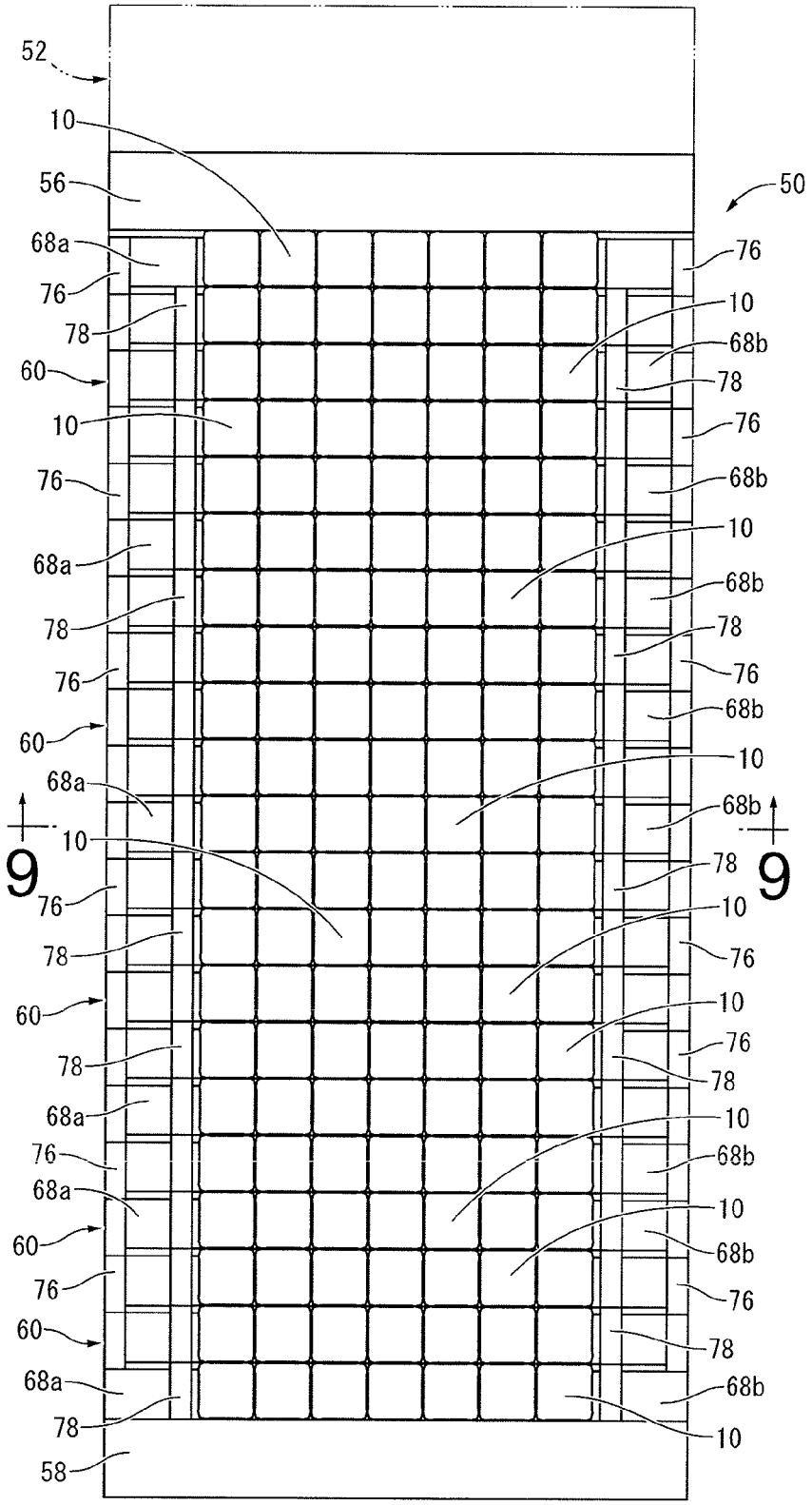
FIG. 7 is a plan view of a mattress using the cushion cell shown in FIG. 1.
Figure 8:
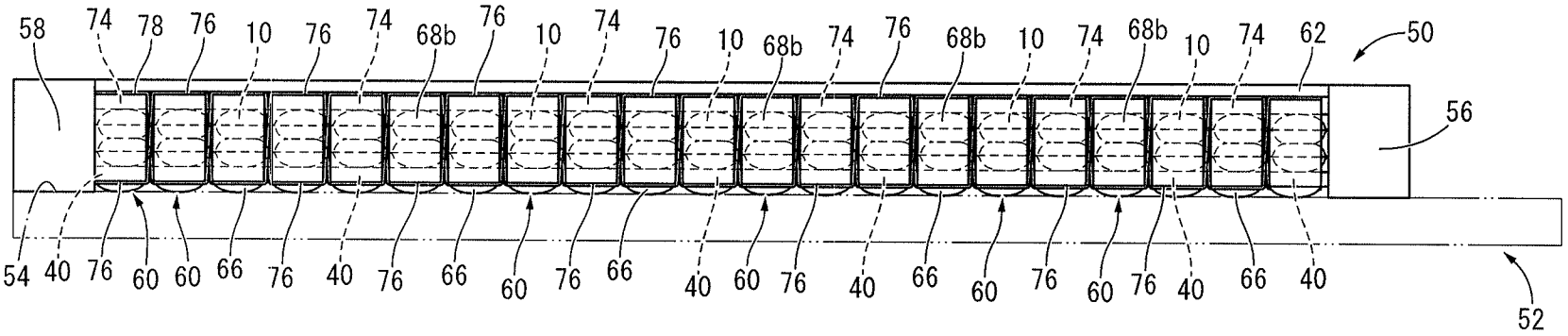
FIG. 8 is a right side view of the mattress shown in FIG. 7.
Figure 9:
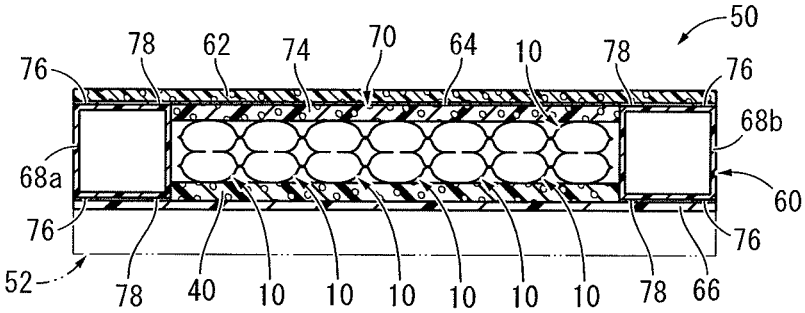
FIG. 9 is a cross section taken along line 9-9 of FIG. 7.

The cushion cell 10 with the structure described above is used for a mattress 50, for example, as a cushion body shown in FIGS. 7 to 9. The mattress 50 is arranged on a human body support surface 54 of a bed 52 with a structure where a plurality of pressure-switching type mattress units 60 are arranged in line in the length direction of the human body support surface 54 between a head-side block 56 and a foot-side block 58 installed at either end of the human body support surface 54 in the length direction, and a surface mat 62 and a body pressure sensor 64 are placed thereon spreading all over the surface of those mattress units 60 (see FIG. 9). In the following descriptions, the width direction, length direction, and height direction generally mean a left-right direction in FIG. 7, an up-and-down direction in FIG. 7, and an up-and-down direction in FIG. 8, respectively. Also, in FIG. 7, for better visualization of the arrangement of connector blocks 68*a*, 68*b* (to be described later) and the cushion cell 10, drawings of the surface mat 62, the body pressure sensor 64, and a top cushion layer 74 (to be described later) are all omitted.

The head-side block 56 and the foot-side block 58 are each in an approximate shape of a cuboid extending in the width direction and formed by an elastic body made of urethane foam or the like. Also, the head-side block 56 and the foot-side block 58 are arranged at either end of the human body support surface 54 of the bed 52 in the length direction and placed apart from each other at a given distance in the length direction.

Also, between the head-side block 56 and the foot-side block 58, a plurality of mattress units 60 are arranged. The mattress unit 60 comprises a base member 66 extending in the width direction of the human body support surface 54, connector blocks 68*a*, 68*b* as connectors provided at either end of the base member 66 in the longitudinal direction, and a cushion portion 70 attached in the middle of the longitudinal direction of the base member 66.

The base member 66, a hard member formed with synthetic resin or metal or the like, is made in a long plate extending in the width direction keeping nearly the same cross-section. Also, the base member 66 of the present embodiment has a top surface made in a flat plane extending over the human body support surface 54 of the bed 52, while the bottom surface is made in a curved plane with the downward protrusion increasing toward the center in the length direction in an overall form of an inverted semicircle, thus limiting the increase in weight and enhancing the mechanical strength [of the base member].

The connector blocks 68*a*, 68*b* are each made in a rectangular hollow box formed with a hard material such as synthetic resin or metal, and as shown in FIGS. 7 and 9, the connector block 68*a* is attached to one end of the base member 66 in the longitudinal direction, while the connector block 68*b* is attached to the other end of the same. And the connector blocks 68*a*, 68*b* are provided with a first connecting belt 76 and a second connecting belt 78 as connecting bands that comprise a connecting means to be described later, thereby connecting the plurality of mattress units 60 to each other in a detachable way at the connector blocks 68*a*, 68*b*.

Although omitted in the drawings, a control unit that controls pressure in the fluid chamber 36 of the cushion cell 10, part of supply and exhaust pipes that supply and exhaust air to and from the fluid chamber 36, and a pressure adjusting means including electromagnetic valves and so forth that switches between communication and shutoff states of the supply and exhaust pipes are stored in the connector blocks 68. Considering the maintainability of such pressure adjusting means, it is desirable to provide the connector blocks 68 with an open-close portion (a door) at least in part of the walls. Furthermore, although omitted in the drawings, the connector blocks 68 are provided with sockets for transmitting electricity and exterior ports for transmitting supply and exhaust fluid in order to send and receive supply and exhaust fluid (air) and electric power between connector blocks 68 adjacent to each other or between the connector block 68 and the cushion cell 10 in an arranged state of the plurality of mattress units 60 that will be described later.

Between the connector blocks 68*a*, 68*b*, the pressure-switching type cushion portion 70 is provided. This cushion portion 70 is structured by a plurality of cushion cells 10 arranged between the bottom cushion layer 40 and the top cushion layer 74 where the height [of the cushion cell] can be adjusted by means of controlling pressure in the fluid chamber 36 provided inside the cushion cell 10 together with the pressure adjusting means mentioned above.

The bottom cushion layer 40 is an elastic body (urethane foam etc.) in a rectangular plate shape with its long side placed in the width direction of the human body support surface 54, and the dimension of the longer side is about the same as that of the base member 66, while the dimension in the width direction of the human body support surface 54 is made nearly equal to that between the opposing faces of the connector blocks 68*a*, 68*b* at both ends.

The top cushion layer 74 is an elastic body (urethane foam etc.) in a plate faun extending in the width direction of the human body support surface 54 with its dimensions in the length and width directions are all about the same as those of the bottom cushion layer 40. Then, the top cushion layer 74 is placed above and facing the bottom cushion layer 40 at a given distance.

Also, a plurality of cushion cells 10 are arranged between the bottom cushion layer 40 and the top cushion layer 74 placed to face each other in the vertical direction, wherein the center portion of each bottom face is supported by the bottom cushion layer 40, while the top cushion layer 74 is overlapped on the top face. This allows the pressure-switching type cushion portion 70 to be formed. Also, the cushion cell 10 is arranged in plurality in a row in the width direction of the human body support surface 54 of the bed 52, and in the present embodiment, seven cushion cells 10 are arranged in a row on one of the bottom cushion layers 40. The top cushion layer 74 overlapped on the cushion cells 10 is made to get closer to and farther away from the bottom cushion layer 40 as the cushion cells 10 are inflated and deflated.

The pressure-switching type mattress units 60 structured as described above are placed in plurality in line in the length direction. In the present embodiment, twenty-one mattress units 60 are placed in lines in the length direction of the human body support surface 54.

Figure 10:
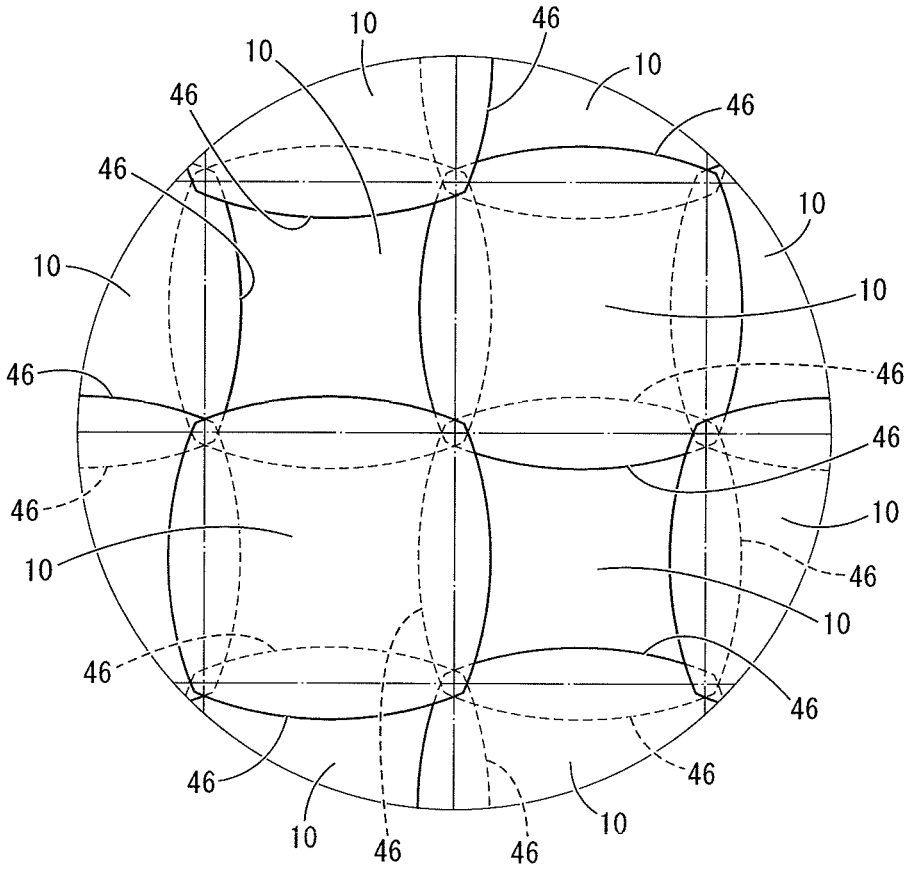
FIG. 10 is a plan view of part of the mattress shown in FIG. 7 in a deflated state of the cushion cell.

As shown in FIG. 10, by placing the plurality of mattress units 60 in lines in the length direction, the disposition area of each cushion cell 10 (the area enclosed by the dashed-dotted lines in FIG. 10) is formed in a square checker board pattern in plan, and the cushion cell 10 is arranged in each disposition area to be placed in plurality in lines and rows. Also, in a deflated state of the cushion cell 10, the outer periphery thereof protrudes out to an adjacent disposition area at least along the side portion 46 (especially the swollen center portion) so that the outer peripheries of cushion cells 10, 10 adjacent to each other are overlapping with each other. In the present embodiment, both the side portion 46 and the corner portion 48 protrude out from the disposition area toward the outer periphery so that the outer peripheries of the cushion cell 10 are overlapping with other adjacent cushion cells 10 all the way round. However, the cushion cell 10 can be in a planar shape in a deflated state to be contained in the disposition area.

As to the mattress units 60 arranged in lines as described above, the ones adjacent to each other in the alignment direction are connected to each other by the first connecting belt 76 and the second connecting belt 78 as connecting bands that comprise a connecting means provided in the connector blocks 68*a*, 68*b*. In the following paragraphs, the connection structure of the connector block 68*a* attached to one end of the base member 66 in the longitudinal direction will be described, but the connection structure of the connector block 68*b* attached to the other end of the base member 66 in the longitudinal direction is similar to that of the connector block 68*a*.

The first and second connecting belts 76, 78 are each in a shape of a thin, narrow and long band being formed with synthetic resin, chemical fiber or synthetic leather or the like. Also, the first and second connecting belts 76, 78 are easily deformable in the thickness direction by an external force, and the strains in the longitudinal direction are preferably small (resistant to expansive deformation). In order to facilitate the positioning and tilting of the connector blocks 68*a*, 68*a* in the length direction, which will be described later, the smaller the strains of the first and second connecting belts 76, 78 in the longitudinal direction, the better [the outcome], but the strains are permissible to the extent that the positioning function and the like of the connector block 68*a* is fully performed for the purpose of facilitating installation and removal of the first and second connecting belts 76, 78 and the wiring and piping of the pressure adjusting means.

Also, the first and second connecting belts 76, 78 are each provided with a Velcro fastener at both ends thereof, not shown in the drawings. More specifically, a Velcro fastener is provided on the top face of one end of the first connecting belt 76 and the bottom face of the other end thereof, while another Velcro fastener is provided on the bottom face of one end of the second connecting belt 78 and the top face of the other end thereof.

And, the first connecting belt 76 is attached to the outside end of the connector block 68*a* in the width direction (outside the human body support surface 54 in the width direction and outside the base member 66 in the longitudinal direction), while the second connecting belt 78 is attached to the inside end of the connector block 68*a* in the width direction (inside the human body support surface 54 in the width direction and inside the base member 66 in the longitudinal direction). Also, one end of the first connecting belt 76 in the length direction is attached to the top face of the connector block 68*a* located on the head side under a detachable condition using a Velcro fastener, whereas the other end of the first connecting belt 76 is attached to the bottom face of the connector block 68*a* located on the foot side under a detachable condition using a Velcro fastener. Further, one end of the second connecting belt 78 is attached to the bottom face of the connector block 68*a* located on the head side under a detachable condition using a Velcro fastener, whereas the other end of the second connecting belt 78 is attached to the top face of the connector block 68*a* located on the foot side under a detachable condition using a Velcro fastener. As evident from above, Velcro fasteners are pre-fixed on the top and bottom faces of the connector block 68*a* at both ends thereof in the width direction. However, the first and second connecting belts 76, 78 can be fixed to the connector block 68*a* in an undetachable way by means of adhesion or welding.

Also, the middle portions in the length direction of the first and second connecting belts 76, 78 each extend between the connector blocks 68*a*, 68*a* adjacent to each other approximately in the vertical direction. These middle portions of the first and second connecting belts 76, 78 are placed along the sides of the connector block 68*a* in the length direction and are allowed to undergo relative displacement to get closer to and farther away from the connector blocks 68*a*, 68*a* without being restricted thereby.

Thus, by having the first and second connecting belts 76, 78 attached to the connector blocks 68*a*, 68*a* adjacent to each other in the alignment direction, those connector blocks 68*a*, 68*a* are connected to each other in the alignment direction by the first and second connecting belts 76, 78. Since the external force that acts on the connector blocks 68*a*, 68*a* to separate from each other in the alignment direction is exerted as a force in a planar direction against the attaching portion (Velcro fastener) of the connector blocks 68*a*, 68*a* of the first and second connecting belts 76, 78, the first and second connecting belts 76, 78 will never come off from the connector blocks 68*a*, 68*a* due to the action of such external force, and the connector blocks 68*a*, 68*a* are maintained in a connected state in the alignment direction.

Moreover, by restricting the expansive deformation of both the first and second connecting belts 76, 78 in the alignment direction, the connector blocks 68*a*, 68*a* adjacent to each other in the alignment direction are limited in the relative displacement both in the alignment direction and the height direction to be positioned relative to each other. In other words, in order for the connector blocks 68*a*, 68*a* to undergo a relative displacement in the alignment direction or the height direction, at least one of the first and second connecting belts 76, 78 needs to extend in the alignment direction, but due to the restricted expansive deformation in the alignment direction, the relative displacement of the connector blocks 68*a*, 68*a* is limited both in the alignment direction and the height direction.

Meanwhile, the connector blocks 68*a*, 68*a* adjacent to each other in the alignment direction are allowed to have a relative tilt around a virtual tilting axis extending between the top ends [of the connector blocks] in the width direction in a state of connection by the first and second connecting belts 76, 78. In other words, the connector blocks 68*a*, 68*a* are allowed to have a relative tilt around the tilting axis extending in the width direction between the upper ends thereof by changing the relative angle between one end of the first connecting belt 76 in the length direction and the middle portion and the relative angle between the other end of the second connecting belt 78 in the length direction and the middle portion. In that case, since the first and second connecting belts 76, 78 are all easily deformable in the thickness direction in the form of a thin band, tilting of the connector blocks 68*a*, 68*a* as described above due to the action of external forces is allowed.

Similarly, the connector blocks 68*a*, 68*a* adjacent to each other in the alignment direction are allowed to have a relative tilt around the virtual tilting axis extending between the bottom ends [of the connector blocks] in the width direction in a state of connection by the first and second connecting belts 76, 78.

The connector blocks 68*b*, 68*b* adjacent to each other in the alignment direction are connected by the first and second connecting belts 76, 78 to be positioned relative to each other in the alignment direction and the height direction in the same way as the connector blocks 68*a*, 68*a*. In addition, the connector blocks 68*b*, 68*b* are allowed to have a relative tilt around the virtual tilting axis extending between the top ends [of the connector blocks] in the width direction and between the bottom ends thereof in the width direction.

Figure 11:
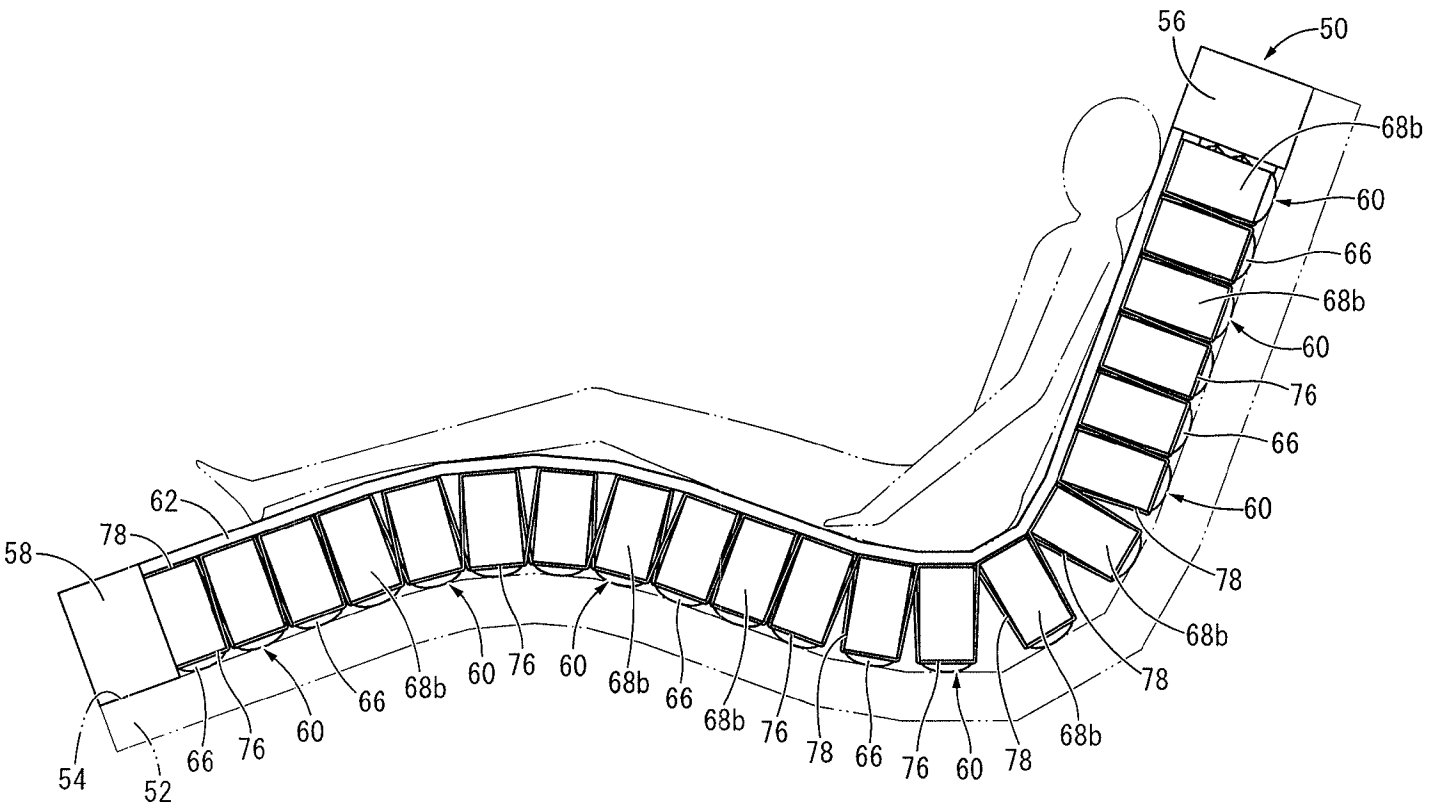
FIG. 11 is a right side view of the mattress shown in FIG. 7 with the back raised.

Thus, by having the connector blocks 68*a*, 68*b* provided on both ends of the base member 66 in the longitudinal direction are all connected to other connector blocks 68*a*, 68*b* adjacent to each other in the alignment direction under a condition of allowing a relative tilt, the mattress unit 60 is made to tilt relative to the other adjacent mattress unit 60. Therefore, as shown in FIG. 11 for example, even if the bed 52 has a head-up tilting mechanism and the human body support surface 54 is bent in the middle portion in the length direction, other connector blocks 68*a*, 68*b* adjacent to each other get tilted to deform the mattress 50 into an upward concave pattern so as to follow the deformation of the human body support surface 54. Also, even if the human body support surface 54 of the bed 52 has a portion that supports the knees during the head-up tilting, which is made to deform into an upward convex pattern, other connector blocks 68*a*, 68*b* adjacent to each other get tilted to deform the mattress 50 into an upward convex pattern so as to follow the deformation of the human body support surface 54.

Thus, all the adjacent mattress units 60 are connected to each other by a single connecting mechanism using the first and second connecting belts 76, 78, while any option among concave deformation, convex deformation, and no deformation is selectively allowed at every connection. Therefore, the mattress 50 is able to freely respond to the differences of deformation modes (head-up tilt) such as being with or without a convex deformation at a support portion on the foot side and bending locations of the bed 52 without any special need for adjustment or parts replacement. In addition, the very simple structure using the first and second connecting belts 76, 78 achieves a flexible connection structure, thus providing an advantage in manufacturability, reliability and weight reduction and the like.

Furthermore, since the first and second connecting belts 76, 78 are attached in a detachable way to the connector block 68*a* with Velcro fasteners, the mattress unit 60 can easily be detached from the other mattress unit 60 by means of detaching the first and second connecting belts 76, 78 from the connector block 68*a*. Therefore, replacement of the first and second connecting belts 76, 78 can easily be performed as a matter of course, and replacement and maintenance of the base member 66 composing the mattress unit 60, the connector block 68 and the cushion portion 70 and so forth can easily be performed.

Thus, in interconnecting the connector blocks 68*a*, 68*b* adjacent to each other with the first and second connecting belts 76, 78 by arranging in lines the plurality of pressure-switching type mattress units 60 on the human body support surface 54, the surfaces of the cushion portions 70 of the plurality of mattress units 60 are made to lie approximately in a single plane. Then, on the surface of the plurality of mattress units 60 connected to each other, the surface mat 62 is overlaid. The surface mat 62 is an elastic body made of urethane foam and the like in a shape of a thin rectangular plate being arranged to cover the upper face of the connector blocks 68*a*, 68*b* and the cushion portions 70 between the head-side block 56 and the foot-side block 58.

And, on the upper face of the cushion portion 70, the body pressure sensor 64 is overlapped, which is arranged in between the surface mat 62 and the cushion portion 70. As such body pressure sensor 64, it is possible to adopt a load cell and the like using a strain gauge or a magneto-striction body, but in the present embodiment, an electrostatic capacitance type sensor in a sheet form is adopted. As such electrostatic capacitance type sensor, ones that have been publicly known (e.g. the one disclosed in U.S. Pat. No. 7,958,789) are adoptable as appropriate so that only a brief description thereof will be given here. That is, the body pressure sensor 64 has a first electrode film in a soft band form overlapped on one face of a dielectric layer formed with an elastomer such as urethane foam, while a second electrode film in a similar shape to the first electrode film with the longitudinal side in a different direction is overlapped on the other face, with a detection portion being configured in between these first and second electrode films facing each other. Then, when an external force such as body pressure (body weight) is applied to the detection portion, the electrostatic capacitance of the condenser composing the detection portion changes in accordance with the change of the thickness of the dielectric layer (i.e. the dimension between the opposing faces of the first and second electrode films) so that the body pressure exerted on the detection portion is detected based on such a change. Especially, the body pressure sensor 64 is preferably thin and flexible so as not to adversely affect the sleeping comfort.

In the present embodiment, the detection portion of the body pressure sensor 64 is provided in plurality of 21 columns and 7 rows, which are placed in arrangement by being positioned with each cushion cell 10 of the cushion portion 70. However, the number of detection portions of the body pressure sensor 64 is not necessarily limited to the same as that of cushion cells 10, but the body weight can be detected with higher precision, for example, by providing more detection portions than the cushion cells 10.

Then, based on the measurement results of the user's body pressure using the body pressure sensor 64, pressure in the fluid chamber 36 in each cushion cell 10 is adjusted. This enables to control the elasticity and height of the cushion cell 10 in such a way that the body pressure is dispersed and exerted over a wide area, thereby restricting the occurrence of bedsore. More specifically, at a portion where the body pressure measured by the body pressure sensor 64 is large, for example, fluid is exhausted from the fluid chamber 36 to reduce the height of the cushion cell 10, whereas at a portion where the body pressure measured by the body pressure sensor 64 is small, fluid is supplied to the fluid chamber 36 to raise the height of the cushion cell 10, thereby dispersing and exerting the reaction force of the user's body pressure over a wide area of the body.

In the mattress 50 of the present embodiment with the structure described above, the side portion 46 of each cushion cell 10 composing the cushion portion 70 is curved in a convex manner toward the outer periphery in a deflated state so that the side portion 46 gets gradually closer to a linear shape as the cushion cell 10 is inflated. Therefore, in an inflated state of the cushion cell 10, the gap formed between the cushion cells 10, 10 placed adjacent to each other is reduced, as shown in *Fig*.7, by reducing the constricted deformation of the side portion 46 of the cushion cell 10, thus effectively dispersing the body pressure by providing a larger support area for the human body.

Also, since the planar shape of the cushion cell 10 can be efficiently made large enough relative to the area for disposition thereof by making the cushion cell 10 in an inflated state into a square shape roughly corresponding to the square-shaped area for disposition, the maximum height of the cushion cell 10 can be made larger. Therefore, the degree of freedom in adjusting the height of each cushion cell 10 is increased to allow a curved surface to be formed corresponding to the human body contours on the mattress 50 in high precision. As a result, dispersion of body pressure can be achieved more effectively, thereby reducing the occurrence of bedsore and the like.

The mattress 50 of the present embodiment especially has the cushion cells 10, 10 adjacent to each other in their deflated state overlapping with each other along the outer peripheries, and the side portion 46 of each cushion cell 10 is allowed to curve in a convex manner toward the outer periphery. Thus, by having each cushion cell 10 overlap with each other in a deflated state, there is no need for matching the shape [of the cushion cell]in a deflated state with the area for disposition thereof, enabling to adopt a form where the outer periphery goes beyond the area for disposition. Therefore, the cushion cell 10 that fits into a shape roughly corresponding to the area for disposition in an inflated state can be adopted, thereby effectively restricting the gap between the cells 10, 10 adjacent to each other in an inflated state. In addition, since the cushion cell 10 is formed by welding along the periphery of each of the plurality of sheets 16, 20, 26 and 30 [sic; each sheet is given a specific name above, translator], cells 10, 10 adjacent to each other are made to readily overlap with each other along the outer peripheries in a deflated state.

Figure 12:
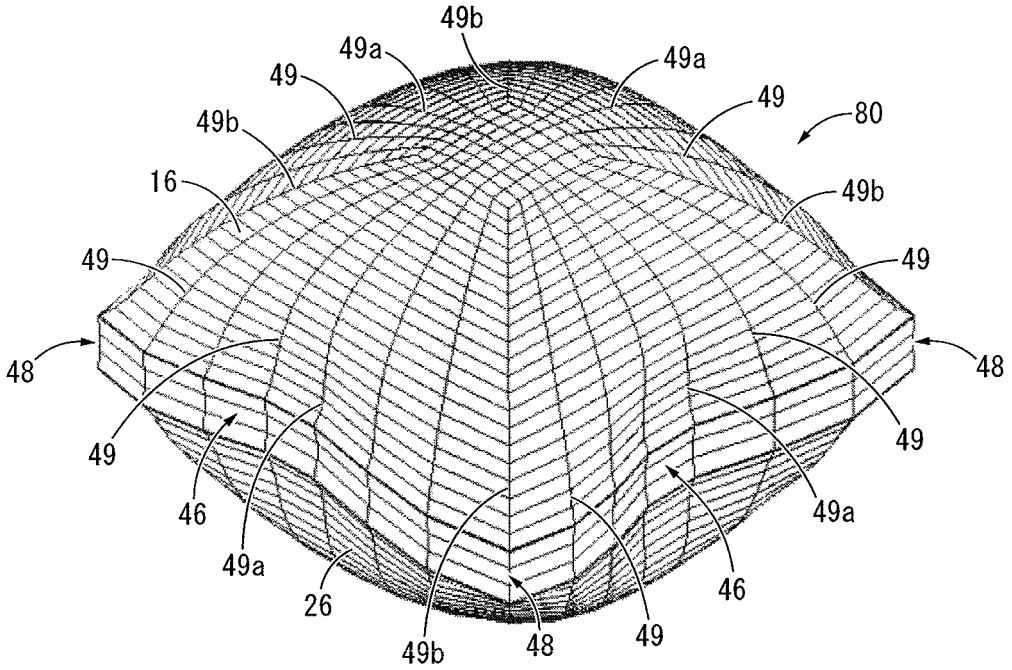
FIG. 12 is a perspective view of a cushion cell in an inflated state as a second embodiment of the present invention.

FIG. 12 shows a cushion cell 80 as a second embodiment of the present invention. The cushion cell 80, made in a single deck structure composed of a single cell body, is formed by welding to each other the outer periphery of the top portion 16 and the bottom portion 26, each made in a sheet form. In other words, the cushion cell 80 of the present embodiment has a structure without the opening 28 of the lower intermediate portion 30 in the lower bag portion 14 as in the first embodiment, and a port 24 similar to that of the first embodiment is provided through the center of the bottom portion 26, although it is not shown in the drawing.

Such cushion cell 80 of the present embodiment, as shown in *Fig*.13, has each side portion 46 curved in a convex manner toward the outer periphery in a deflated state, and is made in an arc protruding to the maximum extent at the center as in the first embodiment. Also, each corner portion 48 is curved in an arc with smaller curvature radius than that of the side portion 46 to create a smooth curve with the side portion 46.

Then, by gradually changing the cushion cell 80 from a deflated state to an inflated state by supplying a fluid such as air to the fluid chamber 36 of the cushion cell 80 via the port 24, the height dimension is increased, while the projected area in the vertical direction is decreased. Consequently, the amount of contraction gets increased in the opposite side direction where the free length is short compared to that in the diagonal direction where the free length is long to bring gradually the curvature of the side portion 46 closer to a linear shape so that the amount of constricted deformation (depression toward the inner periphery) of the side portion 46 against the reference line b is reduced in the inflated state shown in FIG. 14. As evident from FIGS. 13 and 14, the cushion cell 80 of the present embodiment has the side portion 46 made approximately in a linear shape in an intermediate state between the maximum deflated and inflated states, thereby shaping the cushion cell 80 in an approximate square.

This allows the cushion cell 80 of the present embodiment to efficiently obtain the projection area in the vertical direction relative to the area for disposition in an inflated state, and the area of the top face supporting the human body can be secured to the maximum extent. Therefore, dispersion of body pressure can be achieved and the occurrence of bedsore and the like is prevented.

Also, since the free length in the opposite side direction can be made long enough by having the center of the side portion 46 protrude toward the outer periphery, concentration of stresses acting against the center of the side portion 46 can be avoided during inflated deformation of the cushion cell 80, thereby dispersing the stresses. Therefore, damage to the cushion cell 80 caused by concentration of stresses (e.g. failed welding along the side portion 46) is prevented, thus achieving improved durability.

In summary, the applicable range of the present invention is not limited to the cushion cell 10 with the double-decker structure shown in the first embodiment, but similar effects can be produced using the cushion cell 80 with a single deck structure. Still similar effects could be produced by cushion cells with three or more decks with two or more constricted portions 34, provided that they are made in a square with the side portion 46 curved in a convex manner toward the outer periphery.

Embodiments of the present invention have been described in detail above, but the present invention is not limited to those specific descriptions. For example, the side portion 46 is preferably curved in an arc with the amount of protrusion toward the outer periphery reaching the maximum at the center in the length direction, but for example, the amount of protrusion can be at the maximum off the center in the length direction, or even another curved shape can be adopted where the curvature radius gradually changes.

The side portion 46 in an inflated state of the cushion cell is not limited to a linear or a curved shape in a concave manner toward the outer periphery but can be curved in a convex manner toward the outer periphery in an inflated state.

Also, the corner portion 48 is preferably made in a curved shape in order to alleviate the concentration of stresses, but it can also be pointed instead of being curved.

Also in the previous embodiments, the mattress 50 is shown as an example of a cushion body to be arranged on the bed 52, but the cushion body using the cushion cell related to the present invention can be applied to what constitutes a wheelchair seat, for example.

What is claimed is:

1. A cushion cell comprising:

a fluid chamber formed therein such that a height of the cushion cell is changeable by adjusting a pressure in the fluid chamber, wherein a shape of the cushion cell in a deflated state is a square in plan view with each side portion curved in a convex manner toward an outer periphery in plan view in order to reduce concentration of stresses against the center of each side portion when the cushion cell is in an inflated state.

2. The cushion cell according to claim 1, wherein a maximum outward protrusion of the side portion is made 0.05 to 0.15 times a length of the side portion.

3. The cushion cell according to claim 1, wherein the cushion cell comprises a cell body formed by means of fixing at least one set of sheets overlapped on each other along peripheries thereof in a fluid tight manner.

4. The cushion cell according to claim 1, wherein each corner portion of the cushion cell is curved in a convex manner toward the outer periphery, while a curvature radius of the corner portions is made smaller than that of the side portions.

5. The cushion cell according to claim 1, wherein in a plan view of the cushion cell in the deflated state, a center part of each side portion protrudes toward an outer periphery relative to a straight line connecting corner portions located on both sides of each side portion.

6. A cushion body adapted to be arranged on a human body support surface, comprising: a plurality of cushion cells arranged in line on the human body support surface, wherein each of the cushion cells includes a fluid chamber formed therein such that a height of the cushion cell is changeable by adjusting a pressure in the fluid chamber, and a shape of the each cushion cell in a deflated state is a square in plan view with each side portion curved in a convex manner toward an outer periphery in plan view in order to reduce concentration of stresses against the center of each side portion when each cushion cell is in an inflated state.

7. A cushion cell comprising:

a fluid chamber formed therein such that a height of the cushion cell is changeable by adjusting a pressure in the fluid chamber, wherein a shape of the cushion cell in a deflated state is a square in plan view with each side portion curved in a convex manner toward an outer periphery, and wherein each corner portion of the cushion cell is curved in a convex manner toward the outer periphery, while a curvature radius of the corner portions is made smaller than that of the side portions.

8. A mattress adapted to be arranged on a human body support surface, comprising:

a plurality of mattress units arranged in line, wherein each mattress unit comprises a plurality of cushion cells arranged in line, and wherein each of the cushion cells includes a fluid chamber formed therein such that a height of the cushion cell is changeable by adjusting a pressure in the fluid chamber, and a shape of each cushion cell in a deflated state is a square in plan view with each side portion curved in a convex manner toward an outer periphery in plan view in order to reduce concentration of stresses against the center of each side portion when each cushion cell is in an inflated state.

* * * * *